US008100443B2

(12) United States Patent
Talpe

(10) Patent No.: US 8,100,443 B2
(45) Date of Patent: Jan. 24, 2012

(54) SAFETY KNOB

(76) Inventor: Joseph Talpe, Avelgem-Kerkhove (BE)

( * ) Notice: Subject to any disclaimer, the term of this patent is extended or adjusted under 35 U.S.C. 154(b) by 0 days.

(21) Appl. No.: 12/028,910

(22) Filed: Feb. 11, 2008

(65) Prior Publication Data

US 2008/0197642 A1 Aug. 21, 2008

Related U.S. Application Data

(63) Continuation-in-part of application No. 10/595,109, filed as application No. PCT/EP2004/009254 on Aug. 17, 2004, now abandoned.

(30) Foreign Application Priority Data

Aug. 21, 2003 (BE) ..... 2003/0456

(51) Int. Cl.
*E05B 1/00* (2006.01)
*E05B 3/00* (2006.01)

(52) U.S. Cl. ..... 292/347; 292/336.3; 292/DIG. 27; 292/DIG. 37; 292/DIG. 63; 70/214

(58) Field of Classification Search ..... 292/96, 292/152, 336.3, 347, 348, 352, DIG. 2, DIG. 27, 292/DIG. 63, DIG. 64; 70/214, 218, 224; 16/413

See application file for complete search history.

(56) References Cited

U.S. PATENT DOCUMENTS

| | | | |
|---|---|---|---|
| 793,087 | A | 6/1905 | McVitty |
| 2,742,314 | A | 4/1956 | Santo |
| 2,783,074 | A | 2/1957 | Miltner |
| 2,880,606 | A | 4/1959 | Clark |
| 3,206,238 | A | 9/1965 | Speight et al. |
| 4,575,141 | A | 3/1986 | Burns |
| 4,799,371 | A | 1/1989 | Duncan |
| 6,179,352 | B1 | 1/2001 | Schneeberger |

FOREIGN PATENT DOCUMENTS

DE 803 698 4/1951

(Continued)

OTHER PUBLICATIONS

Computer Generated Translation of DE 803698 C from the European Patent Office Website; http://gb.espacenet.com/search97cgi/s97_cgi.exe?Action=FormGen&Template=gb/EN/home.hts.* Translation of DE 803698 C.*

*Primary Examiner* — Thomas Beach
*Assistant Examiner* — Alyson M Merlino
(74) *Attorney, Agent, or Firm* — Sughrue Mion, PLLC

(57) ABSTRACT

Rotary knob or handle 1 for opening and/or closing doors, gates or windows, comprising a first part 2 designed to operate a closing mechanism by rotation around a rotation axis X, a second part 3 which is rotatable around substantially the same axis X, a connecting part 5, which is coupled to said second part 3 in rotation around said axis X. The connecting part 5 is movable with respect to the first part 2 along said axis X, between a first position and a second position. In said first position of the connecting part 5, the connecting part 5, and with it the second part 3, are substantially freely rotatable around said axis X with respect to said first part 2. In said second position of the connecting part 5, the connecting part 5 and the second part 3 are rotationally coupled by a dog clutch to said first part 2. The rotary knob or handle 1 is provided with several push buttons 4 on said second part 3, arranged at an angle with respect to said rotation axis X. Any one of said at least two push buttons, when pushed, displaces said connecting part 5 from said first position towards said second position, closing the dog clutch and enabling the operation of the closing mechanism through rotation of the second part 3.

8 Claims, 2 Drawing Sheets

FOREIGN PATENT DOCUMENTS

| | | | | |
|---|---|---|---|---|
| DE | 803698 | C | * | 4/1951 |
| DE | 31 09 619 | A1 | | 8/1982 |
| DE | 89 03 672 | U1 | | 6/1989 |
| DE | 39 43 290 | A1 | | 11/1990 |
| DE | 199 57 697 | A1 | | 6/2001 |
| DE | 203 05 870 | U1 | | 7/2003 |
| FR | 2 671 126 | A1 | | 7/1992 |

* cited by examiner

SAFETY KNOB

This is a Continuation-in-Part of application Ser. No. 10/595,109, filed Feb. 17, 2006 now abandoned, which was a National Stage Entry Under 35 U.S.C. §371 of PCT/EP2004/009254, filed Aug. 17, 2004. The entire disclosures of prior application Ser. No. 10/595,109 and the priority Belgium Application No. 2003/0456, filed Aug. 21, 2003, are hereby incorporated herein by reference.

BACKGROUND AND SUMMARY OF THE INVENTION

This invention relates to an element for opening and/or closing doors, gates or windows, comprising a first part designed to operate a closing mechanism by rotation around a rotation axis, and a second part, rotatable around substantially the same axis, and designed to be coupled in its rotary motion to the first part.

This element could, for instance, take the form of a rotary knob, a rotatable part, handle and/or lever which may be used to open and/or close a door, gate or window.

Elements to operate closing mechanisms are known and are most of the time rotatable, against the force exerted by a spring, in order to remove a pin and suchlike extending sideways, from a recess in a door post and suchlike in order to open the gate or the door in accordance with the principle of the mechanism with which most inner doors are provided.

However, doors and gates provided with the elements described above are easy to be opened by children. Because of this, these elements have the disadvantage that they cannot be used to prevent children from entering by accident.

The disadvantage described above is partly resolved in the publication of the German patent DE 199 57 697. There an element was disclosed, in the form of a rotary knob, which must be pushed forward against the force exerted by a spring, before the door can be opened by a rotary motion of the knob, in order to prevent doors from being opened by children.

However, the knob described in DE 199 57 697 has the disadvantage that it is only possible to open doors in one direction. At the same time the possibility still exists that children may open the door by accident by leaning against the knob and turning it.

This problem was partially addressed by an element in the form of a door handle described in German patent DE 803 698. This handle comprises a first part designed to operate a closing mechanism by rotation around a rotation axis, a second part which is rotatable around substantially the same axis, and a connecting part, coupled to said second part in rotation around said axis. The connecting part is movable in the direction of said rotation axis between a first position, in which it is substantially freely rotatable around said axis with respect to said first part, and a second position, in which it is substantially coupled to said first part in rotation around said axis. A resilient element is provided which urges the connecting part towards the first position. The second part comprises a push button which can be arranged at a substantial angle with respect to said rotation axis, and which, when pushed, displaces said connecting part from said first position towards said second position. Since said push button no longer needs to be aligned with the rotation axis, this handle is suitable for use in doors that open by pulling as well as by pushing, and is less subject to accidental opening.

However, the door handle of DE 803 698 presents some drawbacks. Although it presents two push buttons, only one of them is functional and displaces the connecting part towards said second position when pushed. The other push button is a dummy button. Since the connecting part and the second part are freely rotatable while the connecting part is in said first position, a user will not have a reliable positional clue as to which one of the two push buttons is the functional button, and which one is the dummy button. Furthermore, the free rotation of the second part may place the functional button in a difficult-to-reach position. Because of this, even an authorized user may lose valuable seconds when trying to open the door, gate or window in an emergency. Moreover, none of the described mechanisms is directly suitable to be used with several functional push buttons.

An object of the present invention is that of providing a child-safe opening and/or closing element which nevertheless does not unnecessarily delay its operation by adults.

A further object of the present invention is that of providing a child-safe opening and/or closing element that can be actuated comfortably and without excessive effort.

To provide this, the element for opening and/or closing doors, gates or windows according to the present invention comprises:

- a first part designed to operate a closing mechanism by rotation around a rotation axis;
- a second part which is rotatable around substantially the same axis;
- a connecting part, which is coupled to said second part in rotation around said axis, and movable with respect to the first part along said axis, between a first position, in which it is substantially freely rotatable around said axis with respect to said first part, and a second position, in which it is substantially coupled to said first part in rotation around said axis; and
- a resilient element urging said connecting part towards said first position; wherein
- the second part comprises at least two push buttons arranged at a substantial angle with respect to said rotation axis, and wherein any one of said at least two push buttons, when pushed, displaces said connecting part from said first position towards said second position.

By carrying out the element in such a manner, it has the advantage that doors, gates or windows may be opened in different directions, preferably by pulling, pushing or sliding. At the same time two operations, namely pushing a push button and giving a rotary motion to the element, have to be performed in order to open a door and suchlike, because of which it will become practically impossible for children to open a door by accident. Nevertheless, the element will still be easily actuated by an adult, in particular in case of emergency, without undue exertion, by pressing any one or several of the buttons and rotating the second part.

In a preferred embodiment of the element according to the invention, each push button comprises a wedge surface inclined with respect to said rotation axis, and said connecting part comprises corresponding surfaces, so that, when any one or several of said push buttons is pushed, said wedge surface will push said connecting part from said first position towards said second position.

In a more particular preferred embodiment of the element according to the invention, the said connecting part and said first part form a dog clutch which closes when said connecting part reaches said second position. This ensures the transfer of the rotary motion of the second part to the first part.

Preferably, the push buttons are located at the outer circumference of the second part. By designing the element in such a manner, doors may be opened independently from the position of the element.

Preferably a total force of at least 25 Newton has to be exerted on one or several push buttons in order to make the said bulges engage the said recesses. In a more particular embodiment, this total force amounts to 50 Newton.

In a preferred embodiment of the element according to the invention, the said element is made of synthetic material or metal such as, for instance, aluminium or stainless steel.

In a most preferred embodiment of the element according to the invention, the said element is a rotary knob.

BRIEF DESCRIPTION OF THE DRAWINGS

In order to further explain the characteristics of the present invention and to show additional advantages and particulars, now a more detailed description of the rotary knob will follow. It may be obvious that in the following description nothing may be interpreted as a restriction of the protection claimed for in the claims of this invention.

By means of reference numbers, reference is made to the attached drawings in which.

DETAILED DESCRIPTION

Figure 1:
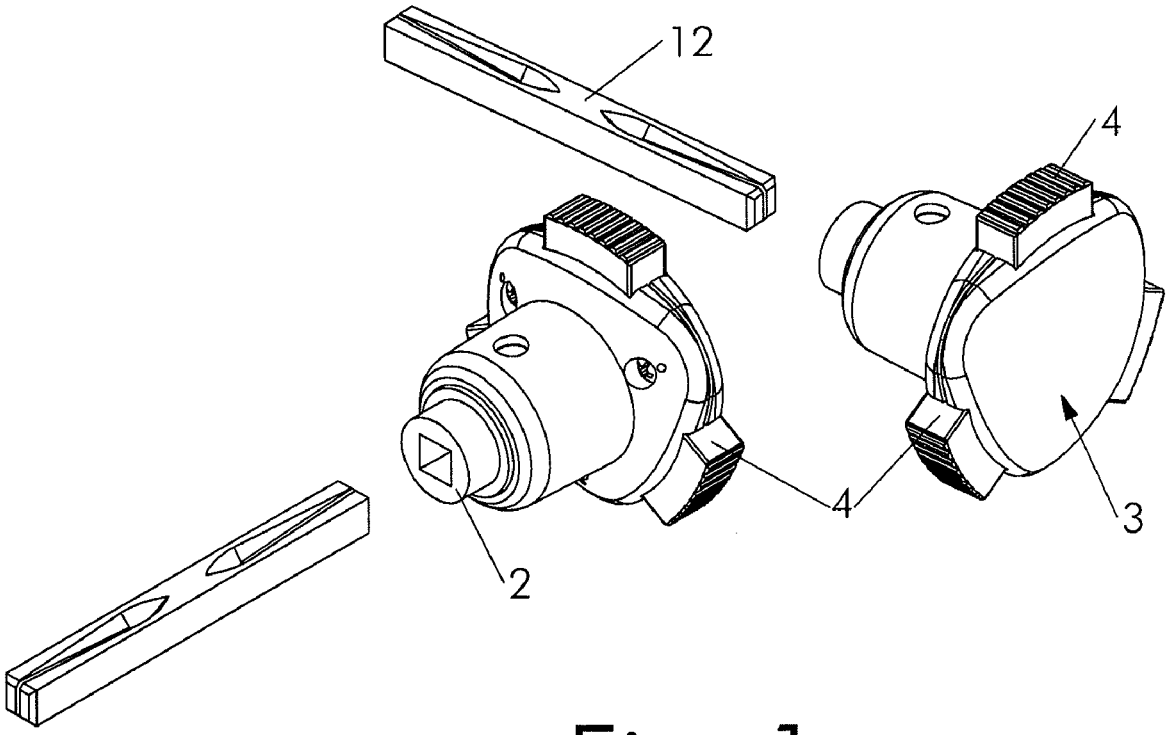
FIG. 1 shows a perspective representation of a rotary knob according to the invention provided with three push buttons.
Figure 2:
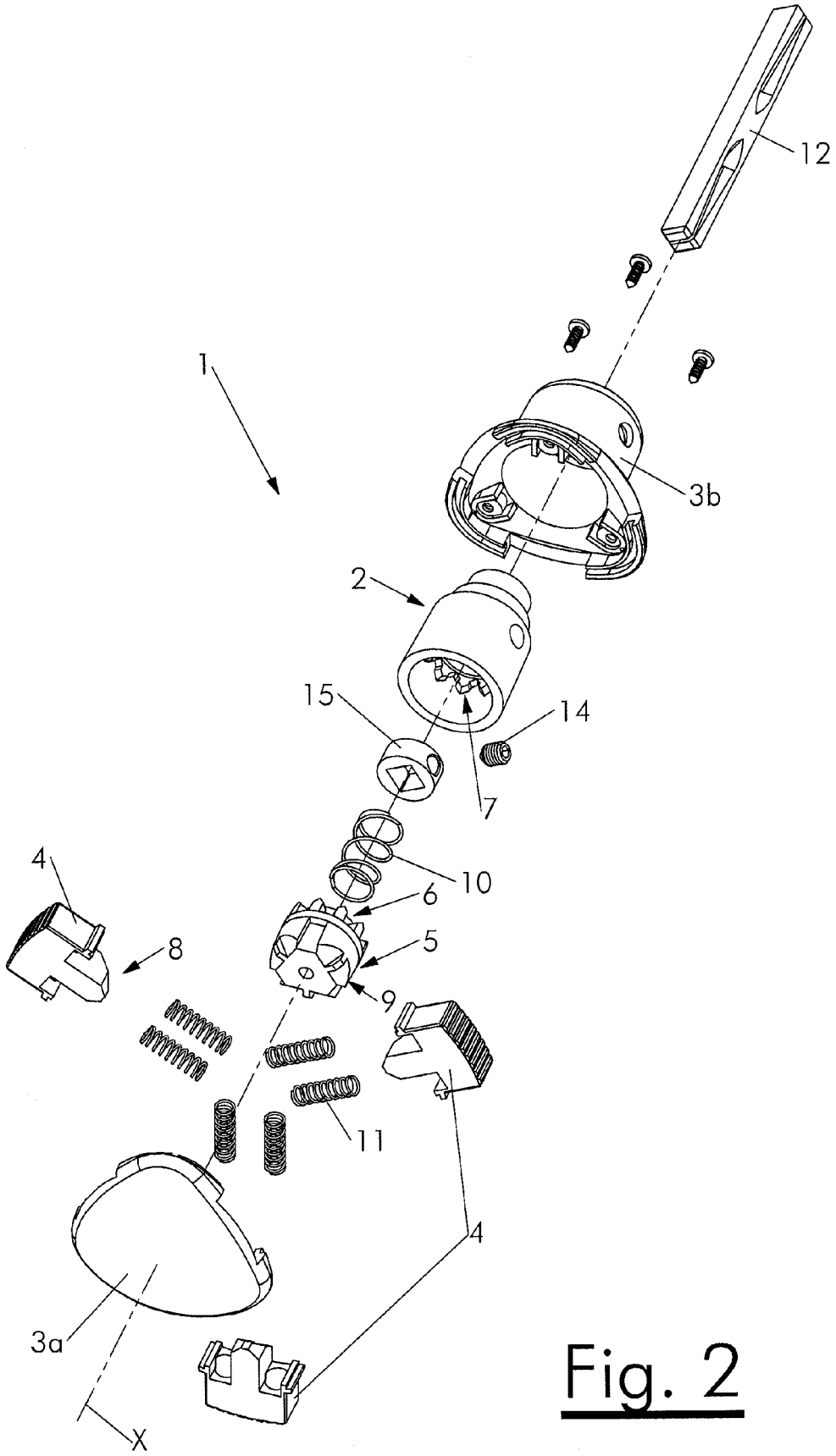
FIG. 2 is representing an exploded view of the rotary knob represented in FIG. 1.

The illustrated preferred embodiment of the invention, in the form of a rotary knob 1 for opening and/or closing doors, gates or windows, comprises a first part 2, designed to operate a closing mechanism by rotation around a rotation axis X, a second part 3, rotatable around substantially the same axis X, and a connecting part 5, coupled with said second part 3 in rotation around said axis X.

The second part comprises a housing 3*b* made of synthetic material that may be closed off by a cover 3*a*. The closing mechanism is operated by means of a pin 12 mounted on the first part 2.

The pin 12 is secured to the first part 2 preferably by means of a metallic ring and an adjusting screw 14.

The rotary knob 1 is provided with several push buttons 4, which are arranged at an angle, more particularly radially with respect to said axis X on the periphery of said second part 3 so that they can be pushed in under this angle, more particularly radially with respect to said axis X. Each one of said buttons 4 comprises an outer contact surface to push said button 4 radially inwardly against pressure springs 11, and, substantially opposite to said contact surface, a wedge surface 8 inclined with respect to said axis X.

The connecting part 5 comprises surfaces 9 complementary to said wedge surfaces 8 of said buttons 4. It also comprises protrusions 6 which can engage corresponding recesses 7 provided in the first part 2 to transmit rotational motion around said axis X as a dog clutch.

So long as no pressure is exerted on the contact surface of any one of these push buttons 4, a pressure spring 10 keeps said connecting part 5 in a first position out of engagement with said first part 2. The connecting part 5 and the second part 3 are then freely rotatable with respect to the first part 2. However, when any push button 4 is pushed against the pressure springs 11, its wedge surface 8 will engage the corresponding surface 9 of the connecting part 5, pushing the connecting part 5 substantially in the direction of said axis X against the spring 10 and towards a second position in which the protrusions 6 will engage the recesses 7, closing the dog clutch between the connecting part 5 and the first part 2 so that a rotary motion of the second part 3 around said axis X can be transferred through the connecting part 5 to the first part 2 and a door may be opened for instance.

The spring 10 may be mounted on the pin 12 and by making use of this space, the rotary knob 1 according to the invention, has the advantage that the rotary knob 1 can take longer pins.

Preferably, a minimum total force of at least 25 Newton has to be exerted on the contact surfaces of the push buttons 4 against the springs 10, 11 to close the dog clutch between the connecting part 5 and the first part 2 so that a rotary motion of the second part 3 around the axis X can be transmitted to the first part 2 and the pin 12.

To open a door, for instance, by means of the illustrated embodiment of the invention, two operations have to be performed, namely pushing at least one push button 4 and performing a rotary motion of the knob 1. Because of this, it is practically impossible for children to open the door by accident.

Although the present invention has been described with reference to a specific exemplary embodiment, it will be evident that various modifications and changes may be made to this embodiment without departing from the broader spirit and scope of the invention as set forth in the claims. Accordingly, the description and drawings are to be regarded in an illustrative sense rather than a restrictive sense.

The invention claimed is:

1. An element for opening and/or closing doors, gates or windows, comprising:

a first part designed to operate a closing mechanism by rotation around a rotation axis;

a second part which is rotatable around substantially the same axis;

a connecting part, which is coupled to said second part in rotation around said axis, and movable with respect to the first part along said axis, between a first position, in which it is substantially freely rotatable around said axis with respect to said first part, and a second position, in which it is substantially coupled to said first part in rotation around said axis; and a resilient part urging said connecting part towards said first position; wherein the second part comprises at least two push buttons arranged at an angle with respect to said rotation axis, and wherein each of said at least two push buttons, when pushed, displaces said connecting part along said axis from said first position towards said second position.

2. The element according to claim 1, wherein each push button comprises a wedge surface inclined with respect to said rotation axis, and said connecting part comprises a corresponding surface, so that, when at least one of said push buttons is pushed, its wedge surface will push said connecting part from said first position towards said second position.

3. The element according to claim 1, wherein said connecting part and said first part form a dog clutch which closes when said connecting part reaches said second position.

4. The element according to claim 1, wherein a total force of at least 25 Newton has to be exerted on said push buttons in order to overcome the resistance of said resilient part to move said connecting part to the second position.

5. The element according to claim 1, wherein said element is made of synthetic material or of metal.

6. The element according to claim 1, wherein said element is a rotary knob.

7. The element according to claim 6, wherein said push buttons are located on an outer circumference of the second part.

8. The element according to claim 2, wherein when two or more of said push buttons are pushed, their wedge surface will push said connecting part from said first position towards said second position.

* * * * *